US009464435B2

(12) United States Patent
Ku et al.

(10) Patent No.: US 9,464,435 B2
(45) Date of Patent: Oct. 11, 2016

(54) METAL CURTAIN WALL SYSTEM OF MONOLAYER STRUCTURE AND CONSTRUCTION METHOD THEREOF

(75) Inventors: Chuan Hul Ku, Shanghai (CN); Wen Hao Ku, Shanghai (CN)

(73) Assignee: Evergrow International Trading (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/344,679

(22) PCT Filed: May 18, 2012

(86) PCT No.: PCT/CN2012/000685

§ 371 (c)(1),
(2), (4) Date: Dec. 15, 2014

(87) PCT Pub. No.: WO2013/037181

PCT Pub. Date: Mar. 21, 2013

(65) Prior Publication Data

US 2015/0107173 A1 Apr. 23, 2015

(30) Foreign Application Priority Data

Sep. 13, 2011 (CN) ..... 2011 1 0269054

(51) Int. Cl.

| | |
|---|---|
| ***E04B 2/00*** | (2006.01) |
| ***E04C 2/08*** | (2006.01) |
| ***E04F 13/08*** | (2006.01) |
| ***E04F 13/12*** | (2006.01) |

(52) U.S. Cl.

CPC . *E04C 2/08* (2013.01); *E04B 2/00* (2013.01); *E04F 13/0816* (2013.01); *E04F 13/0898* (2013.01); *E04F 13/12* (2013.01); *Y10T 29/49888* (2015.01)

(58) Field of Classification Search

CPC .... E04B 2/00; E04B 2002/0284; E04B 2/28; E04B 2/723; E04B 2/88; E04B 2/92

See application file for complete search history.

(56) References Cited

U.S. PATENT DOCUMENTS

| | | | | |
|---|---|---|---|---|
| 4,271,652 | A | 6/1981 | Svensson | |
| 5,845,440 | A * | 12/1998 | Matsuyama | E04B 2/88 52/235 |
| 2009/0193742 | A1 * | 8/2009 | Wolf | E04F 13/147 52/311.1 |

FOREIGN PATENT DOCUMENTS

| | | | |
|---|---|---|---|
| CN | 2672187 | Y | 1/2005 |
| CN | 2719966 | Y | 8/2005 |
| CN | 101748830 | A | 6/2010 |
| CN | 102359209 | A | 2/2012 |
| WO | 94/08106 | A1 | 4/1994 |

OTHER PUBLICATIONS

International Search Report dated Aug. 30, 2012 in corresponding International Application No. PCT/CN2012/000685, with English translation (7 pages).

* cited by examiner

*Primary Examiner* — Patrick Maestri
(74) *Attorney, Agent, or Firm* — Osha • Liang LLP

(57) ABSTRACT

Disclosed are a metal curtain wall system of a monolayer structure and a construction method thereof. The metal curtain wall system comprises a plurality of composite material curtain wall units (1) that are produced in a numerical control manner and have complex models. The plurality of composite material curtain wall units (1) is spliced to form an inner-outer wall body model. Embedded members (2) are arranged in the composite material curtain wall units (1). Lead-out parts of the embedded members are oriented towards the inner and outer wall bodies and are fixed to inner and outer wall bodies. The composite material curtain wall units (1) in vertical adjacency are arrayed in a staggered manner. An elastic structural adhesive (3) is coated on surfaces of the composite material curtain wall units (1). Thin-type metal sheets (4) are covered on the elastic structural adhesive (3). The metal curtain wall system can be produced continuously in a numerical control manner in the production and manufacturing process. The precision of hyperbolic metal is improved in the environment-friendly and energy-saving manufacturing process. With a simple and mature process, the construction difficulty and the construction cost are reduced; resources or space is saved; and the complex digital building project is improved to the rank of the modern scientific and technical industry.

4 Claims, 3 Drawing Sheets

METAL CURTAIN WALL SYSTEM OF MONOLAYER STRUCTURE AND CONSTRUCTION METHOD THEREOF

TECHNICAL FIELD

The present invention relates to a curtain-wall system, specifically to a single-layered metallic curtain-wall system and construction method thereof, which belongs to field of construction material and method.

BACKGROUND ART

In late 1970s, the aluminum alloy windows and doors and curtain-wall industry started in China. The aluminum alloy glass curtain-wall was promoted and applied in the construction industry, and the aluminum alloy windows and doors and curtain-wall industry was developed quickly from nothing, from imitation to self-development, from undertaking construction of small projects to big ones, from production of low-end products to high-tech products, from construction of glass curtain-wall used for doors and windows of low-rise buildings to high-rise buildings, from processing simple low and medium-grade profiles to high grade profile with extruded section, and from relying on imported products to undertaking projects overseas. In 1990s, the emergence of new construction materials further promoted the development of the construction curtain-wall; a new type of construction curtain-wall, namely the metallic curtain-wall, appeared one after another all over China. The metallic curtain-wall means a curtain-wall with the front panel of the curtain-wall being metallic plate, which is a new type of construction curtain-wall, with the glass of the glass curtain-wall replaced with metallic plate. The major materials of the metallic plate include the flowing: aluminum compound plates, single-layered aluminum plates, aluminum cellular boards, fire-proof plates, titanium-zinc-plastic-aluminum composite boards, sandwiched insulation boards, stainless steel plates, color-coated steel plates, enamel steel plates, and so on. The curtain-walls are different because of different materials of the front panels. Therefore, different processing methods should be carried out in the construction process. Because of the excellent processing performance of metallic sheets, various color and good safety performance, the metallic curtain-wall is fully suitable for different kinds of complex shapes, and any concave and convex shapes, or different types of curved lines can be added. As a result, architects can make many different designs, and therefore the metallic curtain-walls are very popular and developed quickly.

The relevant patents disclosed abroad are as follows:

1. Three-dimensional stamping full-length welding polished aluminum curtain-wall. [1] The three-dimensional stamping full-length welding polishing is the method of producing ship model or airplane. In this technology, the curtain-wall is made by splicing the small stamped aluminum plate blocks of 6 mm in thickness. In the research, aluminum plate of 6 mm in thickness is used, and it is made into a continuous shaped surface by means of welding (argon arc welding, full-length welding treatment), followed by polishing to hide seams, so as to gradually form the three-dimensional housing. Finally, marine paint or gel coat is coated on the surface for beautiful appearance and anticorrosion. Every piece of the aluminum plate needs customized manufacturing. Therefore, manpower and machines are necessary, and the full-length welding and polishing of the plates require massive consumption of manpower. The whole technical process requires much time and efforts and the cost is very high.
2. Three-dimensional tension anchoring type metallic curtain-wall. [2] The curtain-wall is made of stainless steel plate, with a customized steel structure. Because this method needs to be separately processed to form the customized steel structure, the products are high in prices. The waterproof treatment needs to be carried out on both sides. Because it is difficult to form waterproof layers, it is necessary to use double skin facade. The major structural components are formed by customized processing to improve the surface precision; however, this greatly increases the costs. In this technology, every separate component is subjected to customized cutting, and there is much waste generated. During the construction process, a big team is required from processing to installation.

Thus, the personnel cost is increased. The problems of this process include big construction errors, small curvature, and bad arcing. In addition, it is necessary to form an inner waterproof layer. However, many rivet heads are exposed to the outside, which impacts the appearance and makes it difficult to remove dusts collected thereon.

3. Three-dimensional stamping type metallic curtain-wall. [3] The curtain-wall is made of stainless steel plate with customized double curved surface made by means of folding and stamping. The curve is formed by a layered system of a secondary structure. That is, it is necessary to cut the steel structure into multiple sections and then connect the sections together to form the curve. It is complicated to attach another layer on the precise frame. Because it is difficult to manufacture waterproof layer on the surface layer, it is necessary to carry out waterproof treatment on both sides. The technology is relatively imprecise, and it requires much manpower and much cost. Components of the steel structure are standard and precise. The key point of changes is to control the length of each section of the steel ribs and each step of the customized manufacturing. This system requires high precision and is difficult to construct. In addition, it requires construction of inner waterproof layers, which cost time and manpower.

In sum, because the digital parametric design has become a new trend in the construction, the inner and outer metallic curtain wall is random and abstract in shaping, and the double-curve shaping is not the traditional bending or bent arc which is difficult to be solved by geometric cutting. Even if it is realized constrainedly, the cost is too high; the product quality is difficult to control because of the processing precision, construction difficulty and even non-uniform stress distribution and insufficient stamping force of metallic material. Therefore, it is necessary to develop a metallic curtain-wall that is low in price, easy in construction, convenient in maintenance and even in stress distribution.

Reference:

[1] Semi-monocoque aluminum construction
CASE STUDY, Lord's Media Centre, London.1999
Design: Future Systems Architects.
Fabrication: Pendenis Shipyards.
[2] 3D Custom Panel System.
CASE STUDY, Experience Music Project, Seattle.2000
Design: Gehry Partners LLP.
Construction: Hoffman Corp.
[3] 3D Standard Panel System
Experience Disney Music Hall, Los Anglese.2003
Design: Gehry Partners LLP.
Construction: Hoffman Corp.

SUMMARY OF THE INVENTION

The present invention discloses a single-layered metallic curtain-wall system and construction method thereof, so as to solve the above disadvantages of the existing metallic curtain-walls.

The objectives of the present invention may be realized by the following technical embodiments:

A single-layered metallic curtain-wall system, comprising a plurality of curtain-wall units that are complex in shape and made of composite material through numerically controlled production, wherein a plurality of composite material curtain-wall units are spliced together to form an inner and outer wall body; embedded parts are provided in the composite material curtain-wall units, and extension part of the embedded part is towards the inner and outer wall body and fixed thereon; upper and lower adjacent composite material curtain-wall units are arranged in a stagger way, and elastic structural adhesive is applied on the surface of the composite material curtain-wall units, and thin metallic sheets are covered upon the elastic structural adhesive.

The composite material curtain-wall unit is one of Glass-fiber Reinforced Gypsum (GRG), Glass-fiber Reinforced Cement (GRC) and Glass-fiber Reinforced Plastics (GRP).

The thin metallic sheet is stainless steel, titanium or copper.

The thin metallic sheets are stacked from bottom up, and the overlapping part of the upper and lower thin metallic sheets is 10 mm. The overlapping stack of the thin metallic sheets is similar to a shingled roof.

Each of the composite material curtain-wall units is provided with a right-angled slot at the edge of the outer surface, with aluminum profile matched with the right-angled slot, wherein the longitudinal section of the aluminum profile is T-shaped, and a presser is provided on the end face of horizontal edge of the aluminum profile; the joint part of the end face of vertical edge and the composite material curtain-wall unit is fixed with a fastener; one end of the end face of the horizontal edge is fitted with the right-angled slot, and the other end is connected with the presser through a fastener; a T-shaped gap is formed between each composite material curtain-wall unit and the two lower adjacent composite material curtain-wall units; and high-performance rubber prefabricated unit is arranged among the T-shaped gaps and fixed by the aluminum profile and the presser. (The description of horizontal edge and vertical edge here only relates to normal writing of "T"; in fact, for inner and outer wall body of different shapes, the T-shaped structure can be inclined, inverted or horizontally placed.)

The distance from inner side of the composite material curtain-wall unit to the inner and outer wall body is 600 mm-1000 mm.

In order to guarantee heat insulation, an insulated block is hung, pasted or nailed to inner side of the composite material curtain-wall unit.

Further, a metallic supporting frame is pre-mounted on the inner and outer wall body for installation convenience.

A construction method of the above single-layered metallic curtain-wall comprises the following steps: 1) manufacturing absolutely precise curtain-wall units that are complex in shape and made of composite material through numerically controlled production, which are then spliced together to form the inner and outer wall body; 2) covering the thin metallic sheets on the surface of the composite material curtain-wall units with the elastic structural adhesive, so as to realize the solid metallic effect as required by the architects.

The present invention has good performance on waterproofness, displacement, fire prevention, heat insulation and maintenance:

1. Waterproofness: by using physical theory, the composite material curtain-wall units are stacked from the bottom up. Because there is wood base under the tiles, the traditional Chinese building, Japanese temple and new type of houses in Europe and America do not have the water leakage problem since ancient times; the present invention uses the same concept to avoid the water leakage problem.
2. Displacement: the displacement problem occurs in case of deflection among the layers, vibration, and temperature difference; therefore, the present invention adopts unit type structure. For example, a projection elevation of 5M×8M is used as one unit. The design with deformation joint around determines size of the expansion joint of aluminum profile according to design of deformation allowed by single building.
3. Fire prevention: because fireproofing grades of the base composite materials GRG and GRC are both A level, and the fireproofing grade of metallic material is also A level, the fireproofing grade of the whole system is A level.
4. Heat insulation: an insulated block is hung, pasted or nailed to back of the curtain-wall.
5. Maintenance: the present invention is different from the common double-layered curtain-wall that includes a waterproof and heat-insulating layer and a decorative layer. The maintenance operation can be performed from the inside and outside at the same time, there is a maintenance path of 600 mm-1000 mm between the true inner decorative layer and the outer curtain-wall, which helps to save space and reduce waste of resources.

Continuous numerically controlled production can be applied in both the production and manufacturing processes of the present invention. The environment-friendly energy-saving manufacturing process helps to improve precision of hyperboloidal metal, and the simple and mature technology helps to reduce construction difficulty and greatly save cost, reduce waste of resources or space, thus the complex digital construction engineering becomes one of the modern technology industries.

In the figures: 1. composite material curtain-wall unit; 2. embedded part; 3. structural adhesive; 4. thin metallic sheet; 5. aluminum profile; 6. presser; 7. rubber prefabricated unit.

DETAILED DESCRIPTION

The following is detailed description of technical features of the present invention in combination with drawings and embodiments.

Figure 1:
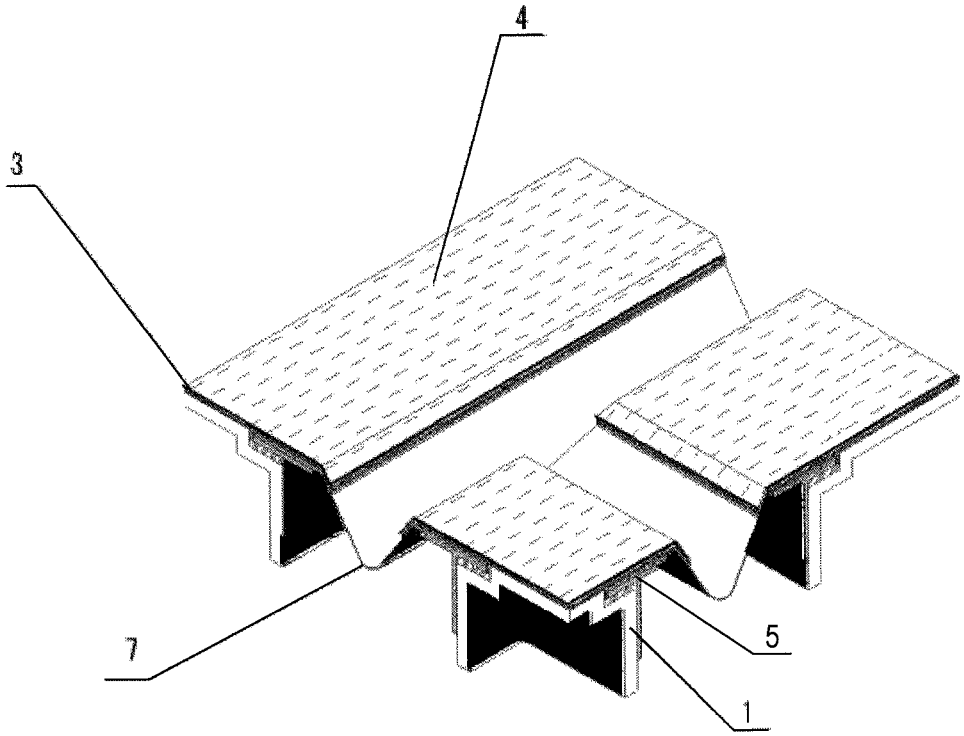
FIG. 1 is the structure diagram of the present invention.
Figure 2:
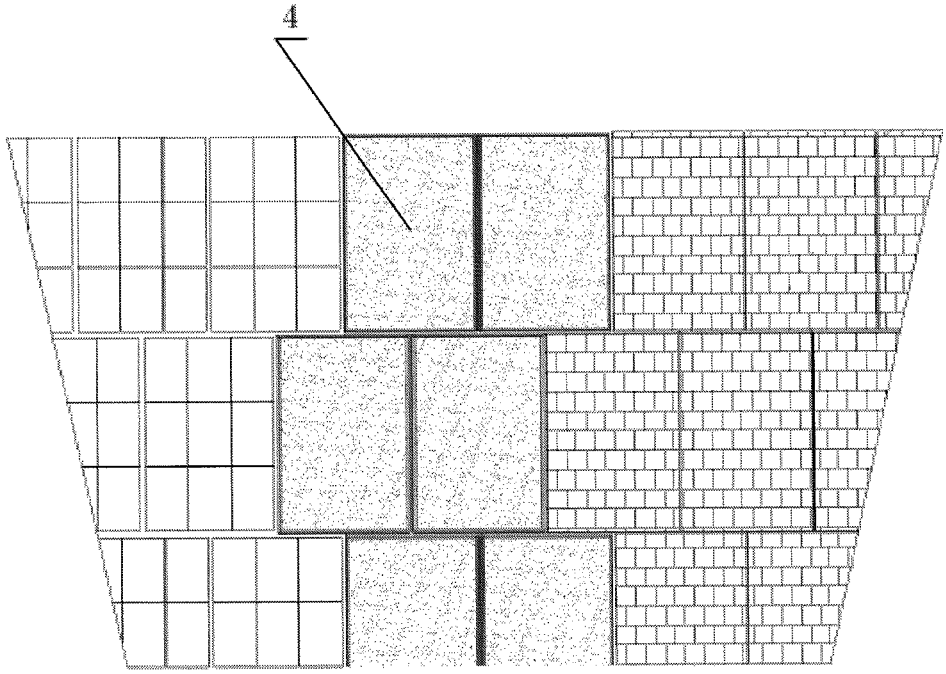
FIG. 2 is the installation structure diagram of composite material of the present invention.
Figure 3:
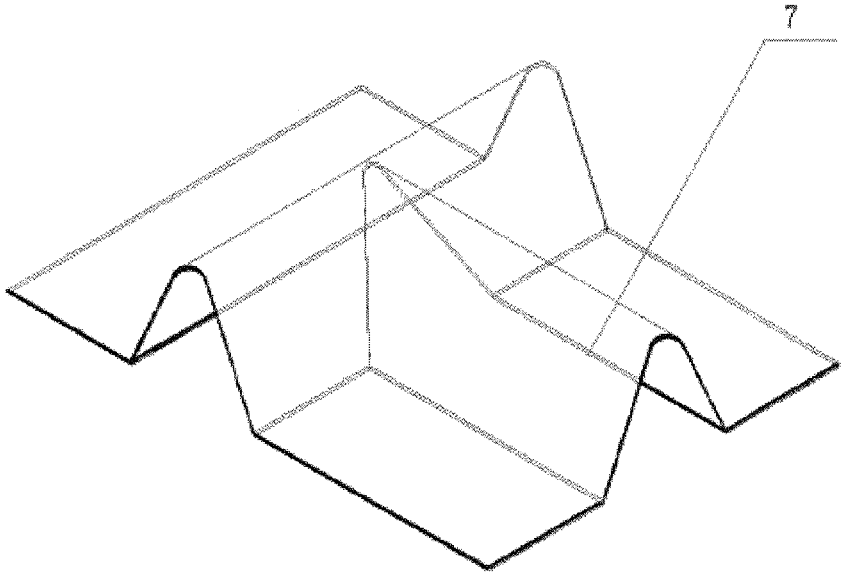
FIG. 3 is the structure diagram of the rubber prefabricated unit of the present invention.
Figure 4:
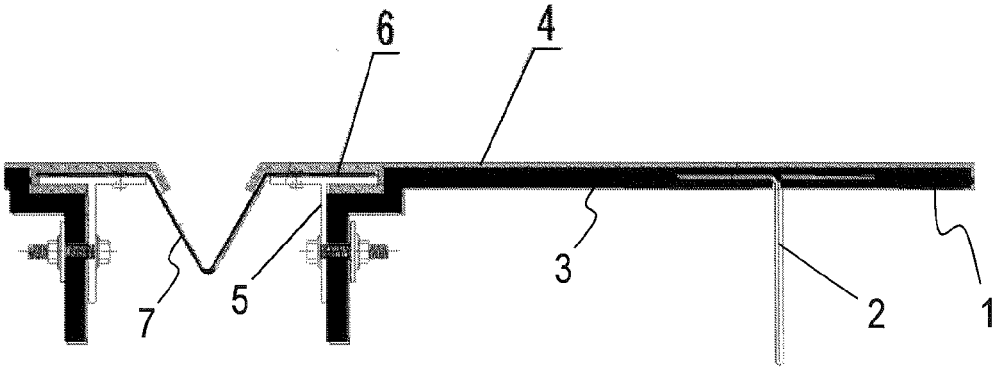
FIG. 4 is the structure diagram of (partial) longitudinal section of the present invention.
Figure 5:
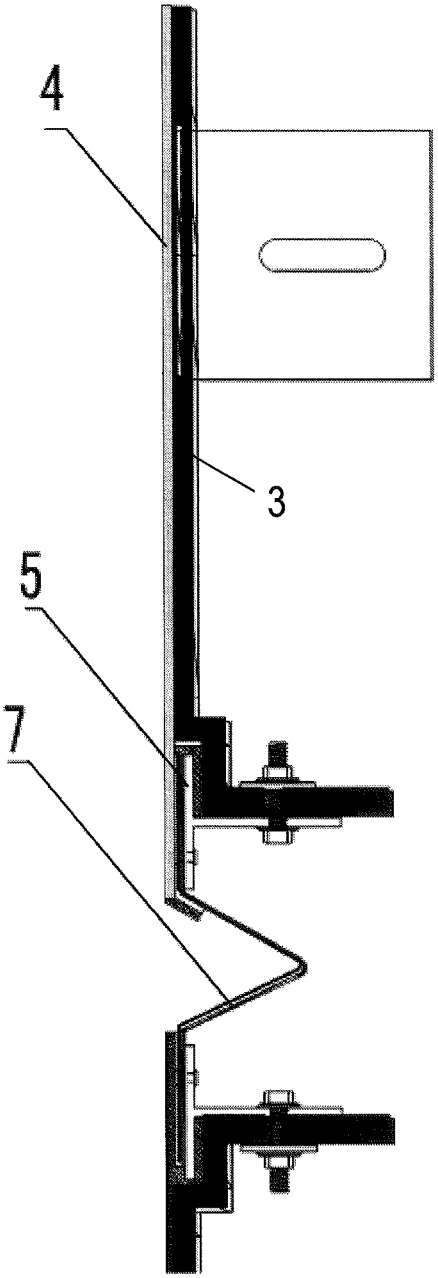
FIG. 5 is the structure diagram of (partial) longitudinal section on the vertical direction of FIG. 4.

As shown in FIG. 1, FIG. 2 and FIG. 3, a single-layered metallic curtain-wall system, comprising a plurality of curtain-wall units 1 that are complex in shape and made of composite material through numerically controlled production, wherein a plurality of composite material curtain-wall units 1 are spliced together to form an inner and outer wall body; embedded parts 2 are provided in the composite material curtain-wall units 1, and extension part of the embedded part 2 is towards the inner and outer wall body and fixed thereon; upper and lower adjacent composite material curtain-wall units 1 are arranged in a stagger way, and elastic structural adhesive 3 is applied on the surface of the composite material curtain-wall units 1, and thin metallic sheets 4 are covered upon the elastic structural adhesive 3.

The composite material curtain-wall unit 1 is one of Glass-fiber Reinforced Gypsum (GRG), Glass-fiber Reinforced Cement (GRC) and Glass-fiber Reinforced Plastics (GRP).

The thin metallic sheet 4 is stainless steel, titanium or copper.

The thin metallic sheets are stacked from bottom up, and the overlapping part of the upper and lower thin metallic sheets is 10 mm. The overlapping stack of the thin metallic sheets is similar to a shingled roof.

Each of the composite material curtain-wall units 1 is provided with a right-angled slot at the edge of the outer surface, with aluminum profile 5 matched with the right-angled slot, wherein the longitudinal section of the aluminum profile 5 is T-shaped, and a presser 6 is provided on the end face of horizontal edge of the aluminum profile; the joint part of the end face of vertical edge and the composite material curtain-wall unit 1 is fixed with a fastener; one end of the end face of the horizontal edge is fitted with the right-angled slot, and the other end is connected with the presser 6 through a fastener; a T-shaped gap is formed between each composite material curtain-wall unit 1 and the two lower adjacent composite material curtain-wall units 1; and high-performance rubber prefabricated unit 7 is arranged among the T-shaped gaps and fixed by the aluminum profile 5 and the presser 6. (The description of horizontal edge and vertical edge here only relates to normal writing of "T"; in fact, for inner and outer wall body of different shapes, the T-shaped structure can be inclined, inverted or horizontally placed.)

The distance from inner side of the composite material curtain-wall unit 1 to the inner and outer wall body is 600 mm-1000 mm.

In order to guarantee heat insulation, an insulated block is hung, pasted or nailed to inner side of the composite material curtain-wall unit 1.

Further, a metallic supporting frame is pre-mounted on the inner and outer wall body for installation convenience.

In actual use, the above single-layered metallic curtain-wall is implemented by the following steps: 1) manufacturing absolutely precise curtain-wall units that are complex in shape and made of composite material through numerically controlled production, which are then spliced together to form the inner and outer wall body; 2) covering the thin metallic sheets on the surface of the composite material curtain-wall units with the elastic structural adhesive, so as to realize the solid metallic effect as required by the architects.

Comparison on the construction cost:

Case 1: for the method disclosed in Three-dimensional stamping full-length welding polished aluminum curtain-wall, the cost is about 4000 Euro/$m^2$; case 2: for the method disclosed in Three-dimensional tension anchoring type metallic curtain-wall, the cost is about 2500 dollars/$m^2$; case 3: for the method disclosed in Three-dimensional stamping type metallic curtain-wall, the cost is about 3500 dollars/$m^2$; however, the cost of the method as disclosed in the present invention is about 4000 RMB/$m^2$.

What is claimed is:

1. A metallic curtain-wall system, comprising a plurality of curtain-wall units that are made of a composite material, wherein the plurality of composite material curtain-wall units are spliced together to form a wall body; upper and lower adjacent composite material curtain-wall units are assembled in a staggered manner such that vertical seams in two neighboring horizontal rows are offset, thereby T-shaped gaps are formed between the assembled curtain-wall units, wherein prefabricated units filling the T-shaped gaps are used to join the neighboring curtain-wall units, and thin metallic sheets are glued on surfaces of the plurality of composite material curtain-wall units via elastic structural adhesive;

wherein at an edge of an outer surface of each of the plurality of curtain-wall units is provided led slot, wherein an aluminum profile fit into the right-angled slot is used to join the prefabricated units and the curtain-wall units.

2. The metallic curtain-wall system according to claim 1, wherein the composite material curtain-wall unit is made of a material selected from the group consisting of Glass-fiber Reinforced Gypsum (GRG), Glass-fiber Reinforced Cement (GRC) and Glass-fiber Reinforced Plastics (GRP).

3. The metallic curtain-wall system according to claim 1, wherein the thin metallic sheet is stainless steel, titanium or copper.

4. A method for constructing the metallic curtain-wall system according to claim 1, comprising the following steps:

1) obtaining the curtain-wall units that are made of a composite material;
2) splicing together the composite curtain-wall units in a staggered manner to form the wall body; and
3) covering the surfaces of the curtain-wall units with the thin metallic sheets using the elastic structural adhesive.

* * * * *